US007367410B2

(12) United States Patent
Sangesland

(10) Patent No.: US 7,367,410 B2
(45) Date of Patent: May 6, 2008

(54) METHOD AND DEVICE FOR LINER SYSTEM

(75) Inventor: Sigbjorn Sangesland, Tiller (NO)

(73) Assignee: Ocean Riser Systems AS, Oslo (NO)

( * ) Notice: Subject to any disclaimer, the term of this patent is extended or adjusted under 35 U.S.C. 154(b) by 283 days.

(21) Appl. No.: 10/507,049

(22) PCT Filed: Mar. 6, 2003

(86) PCT No.: PCT/NO03/00077

§ 371 (c)(1),
(2), (4) Date: Sep. 8, 2004

(87) PCT Pub. No.: WO03/076762

PCT Pub. Date: Sep. 18, 2003

(65) Prior Publication Data

US 2005/0103525 A1 May 19, 2005

(30) Foreign Application Priority Data

Mar. 8, 2002 (NO) ..... 20021179

(51) Int. Cl.
*E21B 7/128* (2006.01)
*E21B 15/02* (2006.01)

(52) U.S. Cl. ..... 175/7; 166/358; 166/367; 166/380; 166/382

(58) Field of Classification Search ..... 166/358, 166/367, 380, 382; 175/7
See application file for complete search history.

(56) References Cited

U.S. PATENT DOCUMENTS 3,489,210 A * 1/1970 Wakefield, Jr. ..... 166/352
4,081,039 A * 3/1978 Wardlaw ..... 175/7
5,184,686 A * 2/1993 Gonzalez ..... 175/5
5,727,640 A 3/1998 Gleditsch
6,056,071 A 5/2000 Scott et al.
6,196,336 B1 * 3/2001 Fincher et al. ..... 175/101

(Continued)

FOREIGN PATENT DOCUMENTS

GB 2 357 101 A 6/2001

(Continued)

OTHER PUBLICATIONS

PCT International Search Report dated May 20, 2003 of Patent Application No. PCT/NO03/00077 filed May 6, 2003.

(Continued)

*Primary Examiner*—F. Zeender
*Assistant Examiner*—Christopher Buchanan
(74) *Attorney, Agent, or Firm*—Vern Maine & Associates

(57) ABSTRACT

Method for drilling and lining a well wherein at least one liner (1, 2, 32) with a larger external diameter than the substantial part of a drilling riser (10) is pre-installed at a point below the substantial part of the drilling riser (10). A bore hole section (21) is drilled after the drilling riser (10) has been installed, the bore hole section having a larger diameter than the at least one pre-installed liner (1, 2, 32). The at least one pre-installed liner (1, 2, 32) is subsequently lowered into the bore hole section (21, 22). A drilling and liner system for implementing the method is also described.

20 Claims, 7 Drawing Sheets

U.S. PATENT DOCUMENTS 6,823,943 B2 * 11/2004 Baugh ..... 166/380
6,857,487 B2 * 2/2005 Galloway et al. ..... 175/171
6,899,186 B2 * 5/2005 Galloway et al. ..... 175/5
7,004,264 B2 * 2/2006 Simpson et al. ..... 175/57
7,066,284 B2 * 6/2006 Wylie et al. ..... 175/65
7,077,211 B2 * 7/2006 Cook et al. ..... 166/380
7,083,005 B2 * 8/2006 Galloway et al. ..... 175/5
7,093,675 B2 * 8/2006 Pia ..... 175/57

FOREIGN PATENT DOCUMENTS

WO WO 0201037 A1 1/2002

OTHER PUBLICATIONS

Norwegian Search Report dated Sep. 2, 2002 of Patent Application No. NO 2002 1179 filed Mar. 8, 2002.

* cited by examiner

METHOD AND DEVICE FOR LINER SYSTEM

RELATED APPLICATIONS

This application is a National Stage of International Application No. PCT/NO03/00077, filed 06 Mar. 2003, which published in the English language and is an international filing of Norway Application No. 2002 1179, filed 08 Mar. 2002. Priority is claimed. Each of these applications is herein incorporated in its entirety by reference.

FIELD OF THE INVENTION

The present invention relates to deep-water exploration drilling equipment, and more particular to a liner system according to the preamble of the appended claim 1.

BACKGROUND OF INVENTION

A slim well is highly desirable since it reduces the costs for drilling and completion substantially. Such a well should be designed with the smallest possible diameter needed. Slim hole drilling has been used onshore for a long time. A limited application of this technique has been used in offshore applications from a floating vessel. Slim hole drilling offers a significant potential in reduction of drill cuttings discharge, reduced volume of drilling fluids, cement, casing string weight, etc. One of the main limitations when drilling in deep waters from floating drilling vessels is the size and the weight of the marine drilling riser. A slim hole allows reduction of the size and the weight of the riser. However, due to the close distance between the pore pressure curve and the fracturing curve, relatively many casing points are normally required to reach the reservoir section. So, even with conventional slim hole drilling, the weight and the size of the marine drilling riser will be significant and require a relatively costly drilling vessel to be used.

Normally, riserless drilling takes place down to the setting point for, e.g., a 20" surface casing, typically 800 m below mudline (BML). Riserless drilling in this context means that the drill string is not enclosed within a tube or riser. Since at this depth the risk of encountering a formation containing fluids and/or gas that may escape is increasing from this point, most deep water drilling systems are based on using a standard 18¾" wellhead, a 18¾" BOP and a 21" marine drilling riser. If fluids and/or gas should escape from the well bore, these will flow into the drilling riser and not pollute the seawater. The standard system is hereafter termed 18¾" wellhead system. Through the system, comprising the drilling riser, the BOP and the wellhead, the casings will be installed. As the second stage of the well bore normally a hole with a size to receive a 13⅜" casing will be drilled. Then a third stage with a hole to receive a 9⅝" casing will be drilled and subsequently a fourth stage to receive a 7" liner will be drilled. Finally a 7" tie-back string for production may be installed. Logging, coring and well testing will normally be performed in a 8½" open hole section below the 9⅝" casings.

Today, a 4¾" open hole through the reservoir section is sufficient for application of standard tools for logging, coring and well testing equipment, etc.

The problem of applying slim hole drilling on deep wells is that there is a limit on how long each section of casing reasonably can be. This puts a limitation on how deep wells that can be drilled using this technique.

SUMMARY OF THE INVENTION

The main objective of the present invention is to reduce the needed diameter of the drilling riser. This is achieved by pre-positioning one or more liners below the substantial part of the drilling riser, preferably inside the surface casing, and drill the holes for these liners using underreamers after the BOP and marine drilling riser have been installed. This would allow a very small diameter riser to be used, and thus allow a low cost drilling vessel to be used. Preferably a set of telescopic liners are installed below the well head.

The present invention thus combines the advantages of normal diameter wells (18¾ wellhead system) and the slim hole system.

Deep water slim hole exploration drilling using a telescopic liner system according to the present invention allows the size of the wellhead, BOP and the marine drilling riser to be reduced significantly compared to conventional 18¾" wellhead systems. The proposed system is preferably based on using a 10¾" marine drilling riser, a 9½" BOP and a 9½" wellhead. The system may also be termed a 9½" wellhead system.

According to a preferred embodiment of the invention, after the conductor casing and surface casing have been run and cemented, only liners may be used to complete the well. Consequently, no shoulder in the wellhead will be required for casing suspension. Only an arrangement for supporting the test string during well testing will be accommodated for. This eliminates time consuming operations for running and retrieving wear bushings.

Optionally, one or more additional casings or tie-back casings can be suspended in the well head after any of the pre-positioned liners have been set, which additional casing or a tie-back casing extends over and internally of the pre-positioned liners, to allow for a higher pressure rating, if required. The additional casing has a smaller external diameter than the riser. In such a case a shoulder or groove in the wellhead will be needed.

BRIEF DESCRIPTION OF THE FIGURES

The invention will be described in detail, referring to the embodiments shown in the appended drawings, wherein.

DETAILED DESCRIPTION OF THE INVENTION

Figure 1:
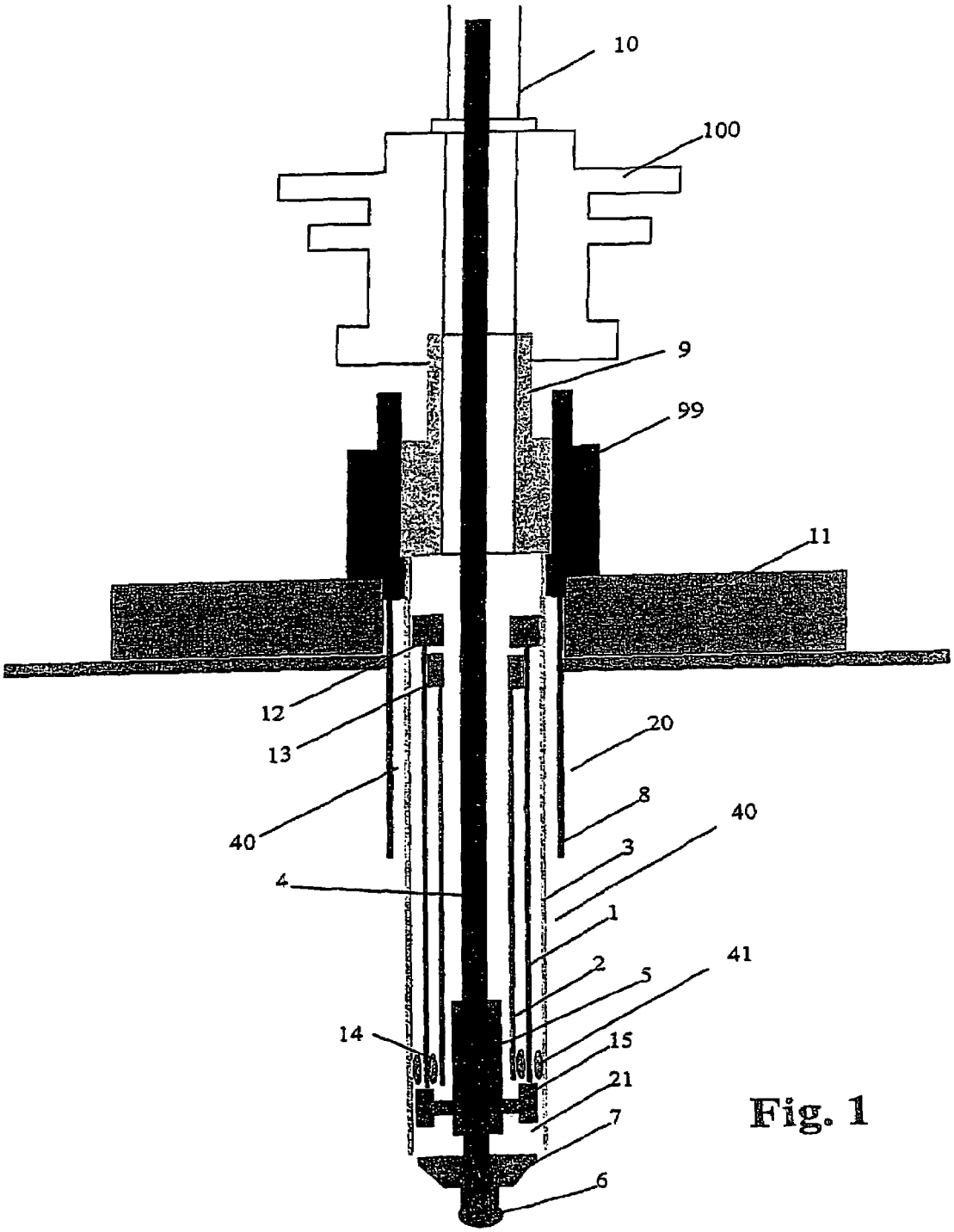
FIG. 1 shows satellite well with a pre-positioned telescopic liner system according to present invention.

FIG. 1 illustrates the concept of a satellite well with a pre-positioned telescopic liner system according to present invention based on using a set of pre-positioned liners consisting of a 11¾" liner 1 and a 9⅝" liner 2 inside a 14"

surface casing 3 connected to the wellhead 9. A 5" drill string 4 with a mud motor 5, a bit 6 and an underreamer 7 is used.

In a first step a temporary guidebase 11 is installed and a bore hole 20 is drilled or jetted down to about 100 m BML (below mud line) in a conventional way without using a drilling riser and BOP. An 18⅝ conductor casing 8 with a conductor housing 99 attached on top is then installed in the borehole 20.

Then the next hole section 40 is normally also drilled without BOP and drilling riser.

After this a unit comprising a well head 9, the 14" surface casing 3, and a set of the telescopic liners 1, 2 is installed.

The well head 9 connected to the surface casing 3 with the pre-positioned liners 1, 2 suspended inside is run in hole 40 and landed in the conductor housing 99 using the drill string. Optionally, these components may also be installed separately by first installing (and cementing) the 14" surface casing 3 and then install the telescopic liners 1, 2 inside of the 14" surface casing with the well head 9 on top using the drill string.

The well head 9 connected to the surface casing 3 with the pre-positioned liners 1, 2 suspended inside the surface casing 3 can also be lowered by suspending it to the lower end of the drilling riser 10. Preferably, a blow out preventer (BOP)-100 is also installed on top of the well head 9.

The pre-positioned liners 1, 2 can also be lowered by suspending it inside the lower part of the drilling riser 10. Preferably, a blow out preventer (BOP)-100 is also connected to the lower most end of the drilling riser.

The pre-positioned liners 1, 2 can also be lowered by suspending it to the drill string. Preferably, a blow out preventer (BOP)-100 is also connected to the wellhead.

The set of telescopic liners 1, 2 are suspended inside of the 14" surface casing 3 by a first hanger 12 at the upper end of the 11¾", liner 1, gripping the inside of the 14" surface casing 3 and a second hanger 13 at the upper end of the 9⅝" liner 2, situated below the first hanger 12 and gripping the inside of the 11¾" liner 1. At the lower end of the liners 1, 2 a temporary sealing 14 is placed between the liners 1 and 2, to seal off the annulus between the liners 1 and 2.

The liners may initially be hung off in the casing by any releasable conventional hanger means, such as slips, J-slots, shear pins or similar.

The surface casing 3 will be cemented in substantially the same way as will be explained in connection with FIG. 2 below, and to avoid cement entering the annulus between the surface casing 3 and the first liner 1 a temporary sealing 41 is sealing the lower end of this annulus.

The drill string 4 may be lowered through the drilling riser 10, the well head 9 and the set of telescopic liners 1, 2. The mud motor 5 is situated near the lower end of the drill string 4. At the lower end of the drill string 4 the 8½" drill bit 6 is connected. Just above this the 14" underreamer drill bit (expandable bit) 7 is connected. The underreamer 7 is of a per se known design. It has the capacity to be retracted and expanded so that it in a retracted position has a diameter that will pass through the 9⅝" liner 2 and in an expanded position has ha diameter of about 14". The drill string is lowered through the drilling riser 10, the well head 9 and the set of telescopic liners 2, 3 with the underreamer 7 in retracted position. When the underreamer 7 has reached a position below the lower end of the telescopic liners 1, 2 (and preferably also below the surface casing 3) the underreamer 7 will be expanded in a per se known way.

Alternatively to the underreamer 7 a pre-positioned core bit 15 may be used. The pre-positioned bit 15 is ring shaped with an internal diameter allowing the 8½" drill bit to pass, and an outer diameter of about 14". The pre-positioned bit 15 is suspended to the lower end of the set of telescopic liners 1, 2 before installing these. The suspension is preferably done by shear pins (not shown) that may be broken when the pre-positioned bit 15 is to be used, or slips that may be retracted when the pre-positioned bit 15 is to be used. When the drill string 4 is lowered through the internal diameter of the pre-positioned bit 15 formations (not shown), e.g., ridges, dogs or the like, on the drill bit 6 or on the lower end of the drill string 4 will interact with formations on the pre-positioned bit 15 to engage the drill string 4 with the pre-positioned bit 15. When the drill string 4 is further lowered or rotated the shear pins will be broken or the slips will be retracted to disengage the pre-positioned bit 15 from the set of telescopic liners 1, 2. Then the pre-positioned bit 15 in combination with the drill bit 6 will be used for drilling the next bore hole section 21 with a 14" diameter for installation of the 11¾" pre-positioned liner 1. When this bore hole section 21 is finished, in the case of an underreamer 7 being used, the underreamer 7 will be retracted and run to the surface by the drill string 4. In the case of a pre-positioned drill bit 15 being used, the drill bit 15 may be disconnected from the drill string 4, e.g., by breaking shear pins of retracting slips, in a per se known way, and simply be left downhole. The 8½" drill bit will be able to pass through the internal diameter of the pre-positioned drill bit 15 anyway, and the internal diameter may be made large enough for the 9⅝" liner 2 to pass.

Figure 2:
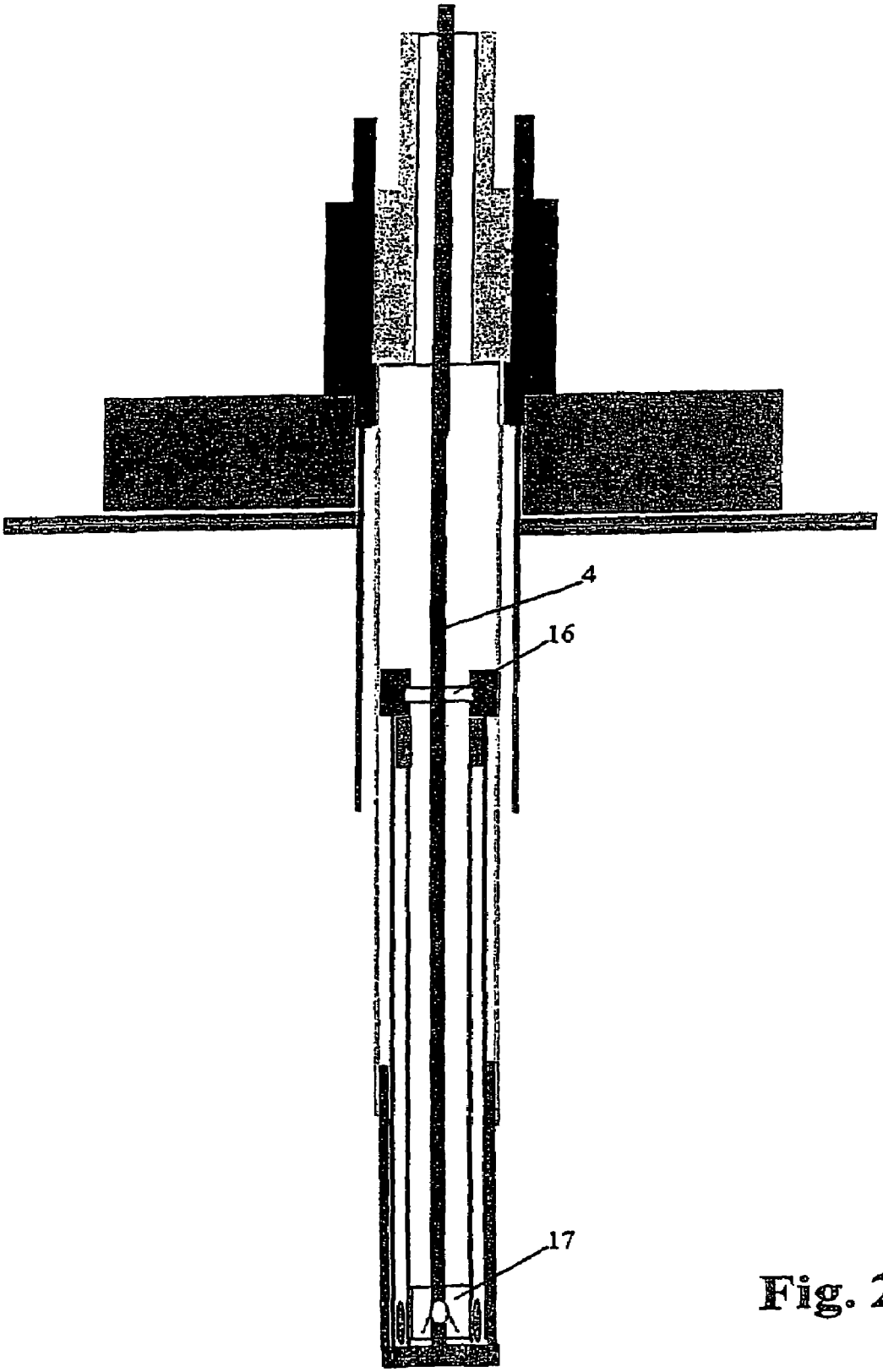
FIG. 2 illustrates the cementing of the first liner of the pre-positioned telescopic liner system of FIG. 1.

After the drilling of the bore hole section 21, the cementing of the pre-positioned liners may take place as illustrated in FIG. 2. The 11¾" liner is run in place using the drill string 4. To facilitate this the drill string 4 is equipped with a liner hanger running tool 16, which is designed to engage with the first hanger 12 on the 11¾" liner 1, release the first hanger 12 from the surface casing 3 and hold the 11¾" liner while the drill string is lowered. The 11¾" liner is hung off in the surface casing 3 by the first hanger 12.

The drill string 4 is extended from the liner hanger running tool 16 to the lower end of the 11¾" liner 1. A cementing shoe 17 is connected to the lower end of the drill string and connects to the lower end of the 9⅝" liner. The cement is conducted through the drill string 4. To avoid cement entering the annulus between the two liners 1 and 2, the annulus is sealed off at the lower end by the temporary seal 14, described in connection with FIG. 1. The cement flows from the cementing shoe 17 across the lower ends of the liners 1, 2 and upwards into the annulus formed between the 11¾" liner 1 and the bore hole section 21. The cement may also flow into the annulus between the 11¾" liner 1 and the surface casing 3.

Figure 3:
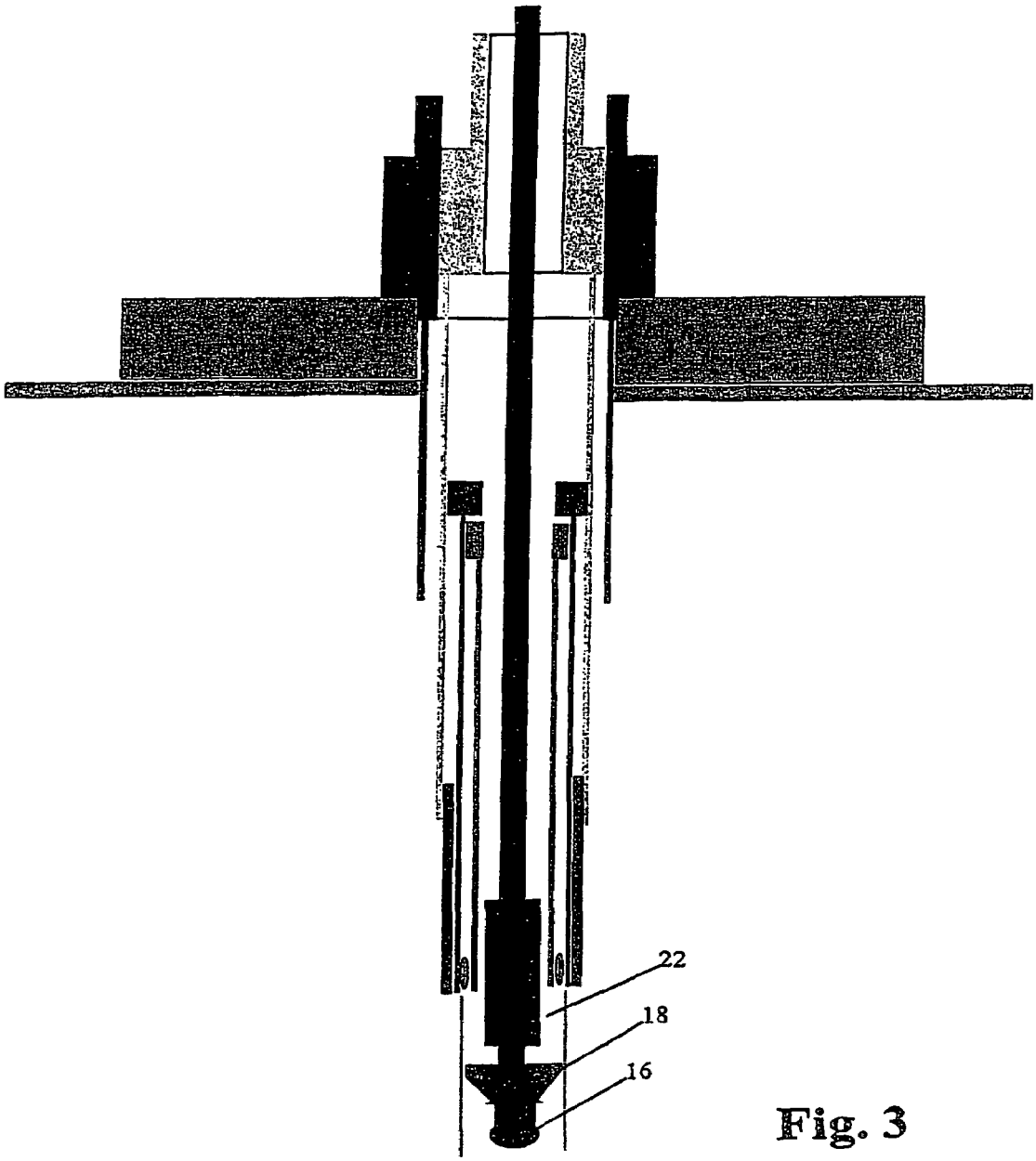
FIG. 3 illustrates the drilling of the hole for the second stage of the pre-positioned telescopic liner system of FIG. 1.
Figure 4:
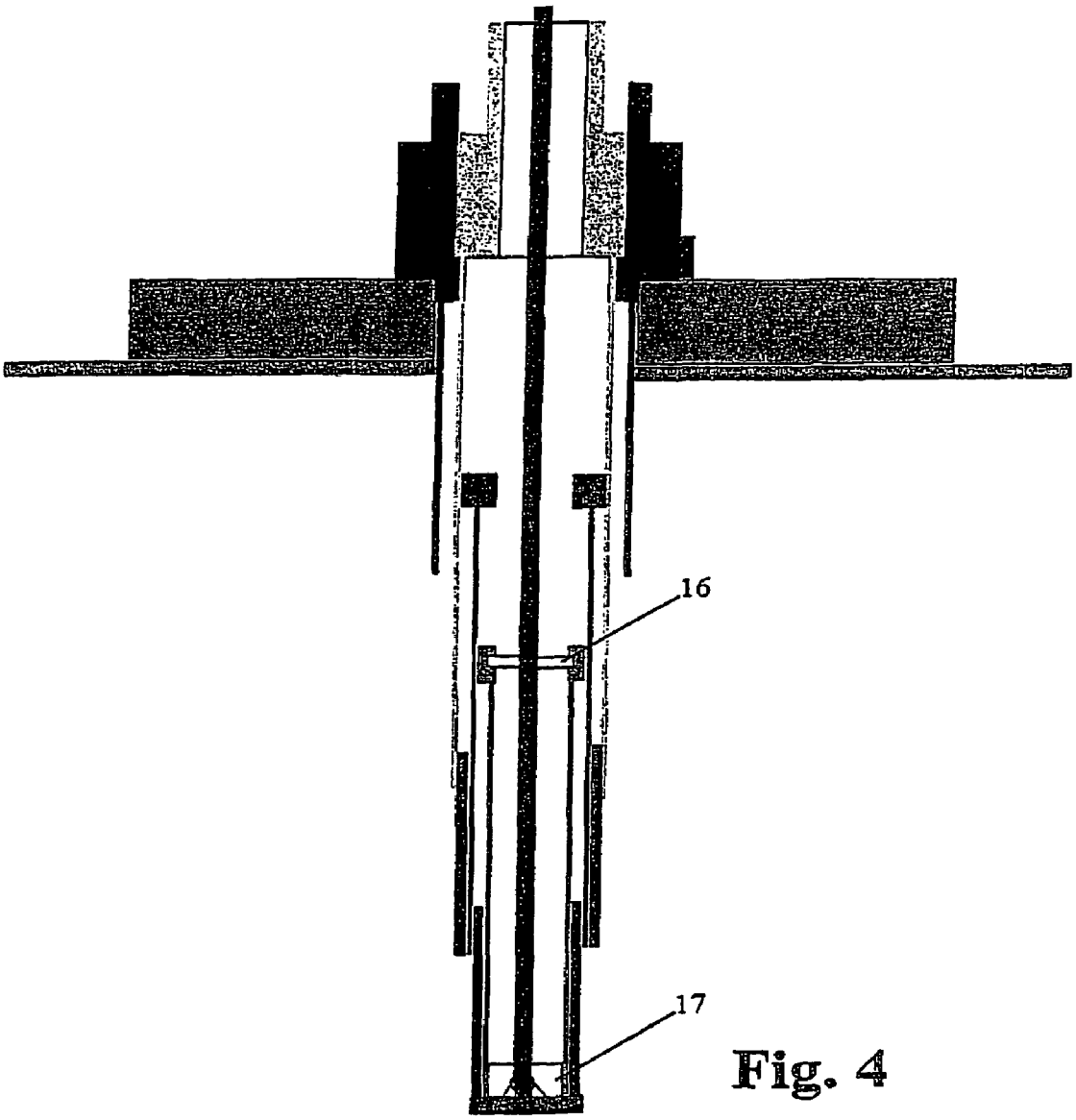
FIG. 4 illustrates the cementing of the second liner of the pre-positioned telescopic liner system of FIG. 1.

FIG. 3 illustrates drilling of a 12¼" bore hole section 22 for the 9⅝" pre-positioned liner 2. After the bore hole section 22 is drilled, the 9⅝" liner 2 is gripped by the same liner running tool 16 that was used to lower the 11¾" liner 1. The lowering of the 9⅝" liner 2 is conducted in the same way as the 11¾" liner 1, and will consequently not be described in detail. After the 9⅝" liner 2 is lowered the same cementing tool 17 is used for installation and cementing of the 9⅝" liner 2 as for the 11¾" liner 1. FIG. 4 illustrates cementing of the liner 2, which is conducted in substantially the same way as for the 11¾" liner 1. Finally, a 8½" hole (not shown) is drilled, and a 7" liner is run and cemented in a conventional way.

Figure 5:
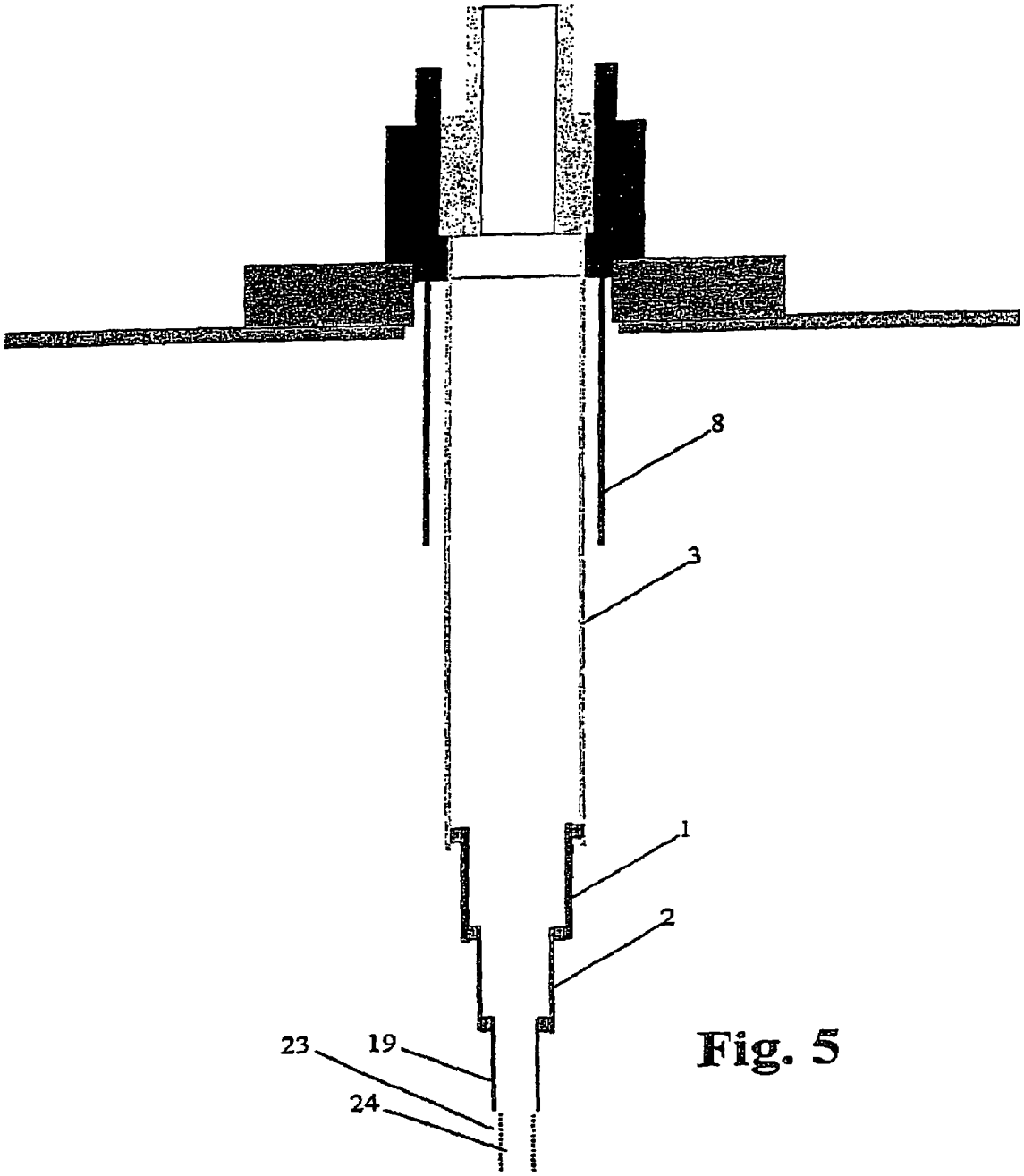
FIG. 5 shows the complete set of liners after the drilling of the well is completed.

FIG. 5 shows the complete casing program. The 18⅝" conductor casing is set at, e.g., 2620 m MD (Measure Depth) (100 m BML) and the 14" surface casing 3 is set at 3320 m MD (800 m BML). The invention requires the use of a proper underreamer 7 that can pass through the internal diameter of the 10¾" riser 10, which is typically 9½", and through the internal diameter of the 9⅝" liner 2, which is typically 8½" or a pre-positioned drill bit 15. For the 11¾" pre-positioned liner 1, a 8½" bit 6 and a 14" underreamer is used for drilling the hole section 21 to 4020 m MD (1500 m BML). Alternatively, the pre-positioned core bit 15 can be run along with the pre-positioned liners 1, 2. When the drill string 4 with the 8½" bit 6 is in place, the core bit 15 is connected and run along with the bit 6. After the borehole section 21 has been drilled to final depth, the core bit 15 is left in the hole and allows the 9⅝" pre-positioned liner 2 to pass through.

Alternatively to first drilling the bore hole section 21 and subsequently lowering the liner 1 into the bore hole section, it is also possible to lower the liner 1 simultaneously with the drilling. Thus, the pre-positioned drill bit 15 may also be rotatable connected to the lower end of the liner 1, so that as the pre-positioned drill bit 15 is churning down the formation, the liner 1 will be drawn downward, preferably without rotating.

For the 9⅝" pre-positioned liner 2, the 8½" drill bit with a 12¼" underreamer 18 (see FIG. 3) is used for drilling the hole section to 4720 m MD (2200 m BML). The 12¼" underreamer 18 may be the same as the underreamer 7, wherein the underreamer 7 is designed to be retracted from a 14" diameter to an intermediate position of 12¼" diameter. Alternatively, the 12¼" bit is a separate underreamer that replaces the underreamer 7.

After the pre-positioned telescopic liners 1, 2 are installed and cemented, an 8½" hole section 23 is drilled for a 7" liner 19. The 7" liner is installed through the drilling riser 10 and cemented in a conventional way. If a deeper well is needed, a 6" hole section 24 can be drilled for a 5" liner (not shown).

Figure 6:
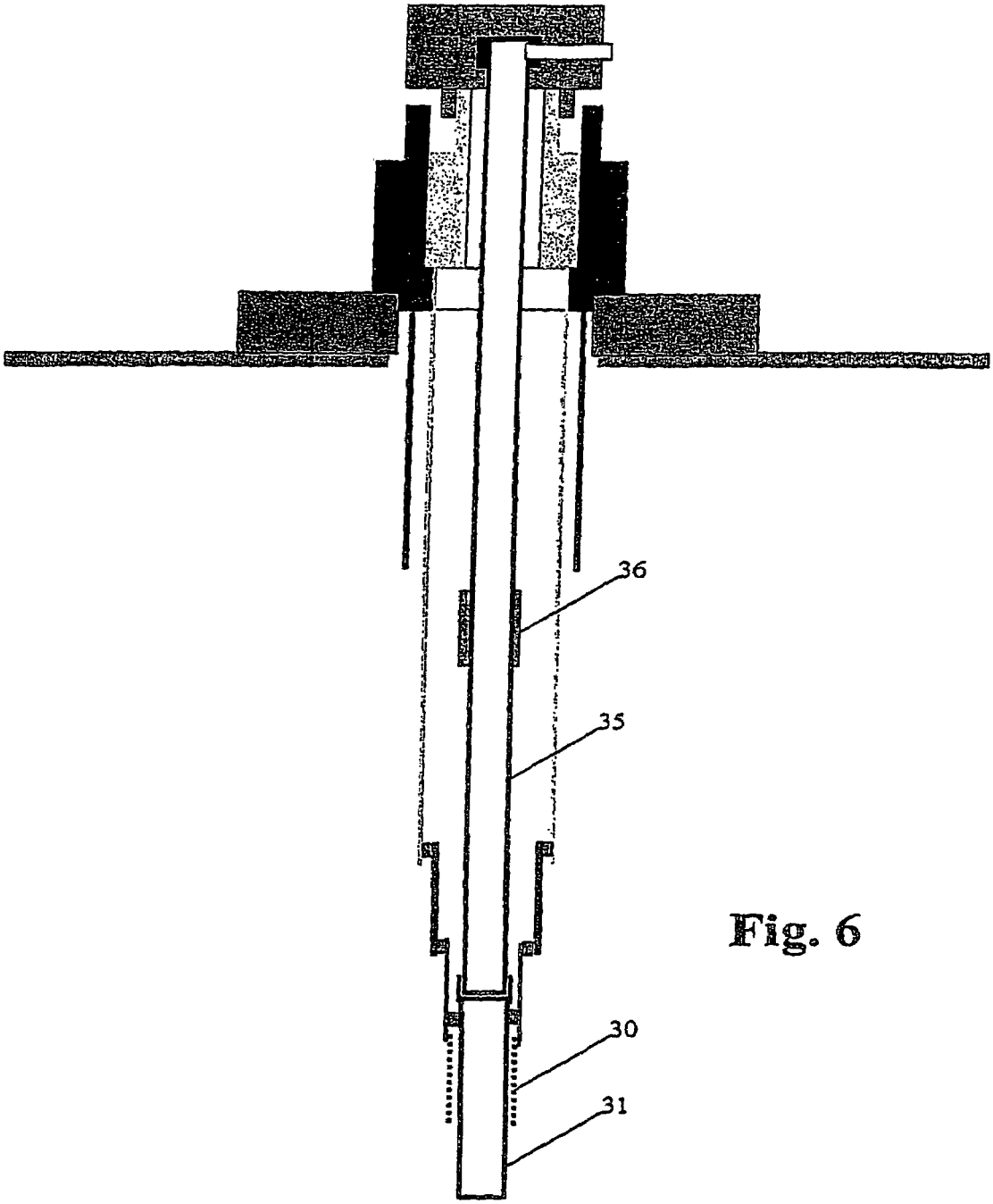
FIG. 6 illustrates an embodiment of the invention using an expandable liner.

FIG. 6 illustrates the use of an expandable contingency liner 30. This liner is set in the 9⅝" pre-positioned liner 2, and expanded from 6,25"×6,875" to 7,828"×8,542". This allows a 7" liner 31 to pass through. For the 7" liner 31, an underreamer (not shown) with a diameter of 7⅞" to 8½" is used for drilling a hole section to 5720 m MD (2500 m BML).

Figure 7:
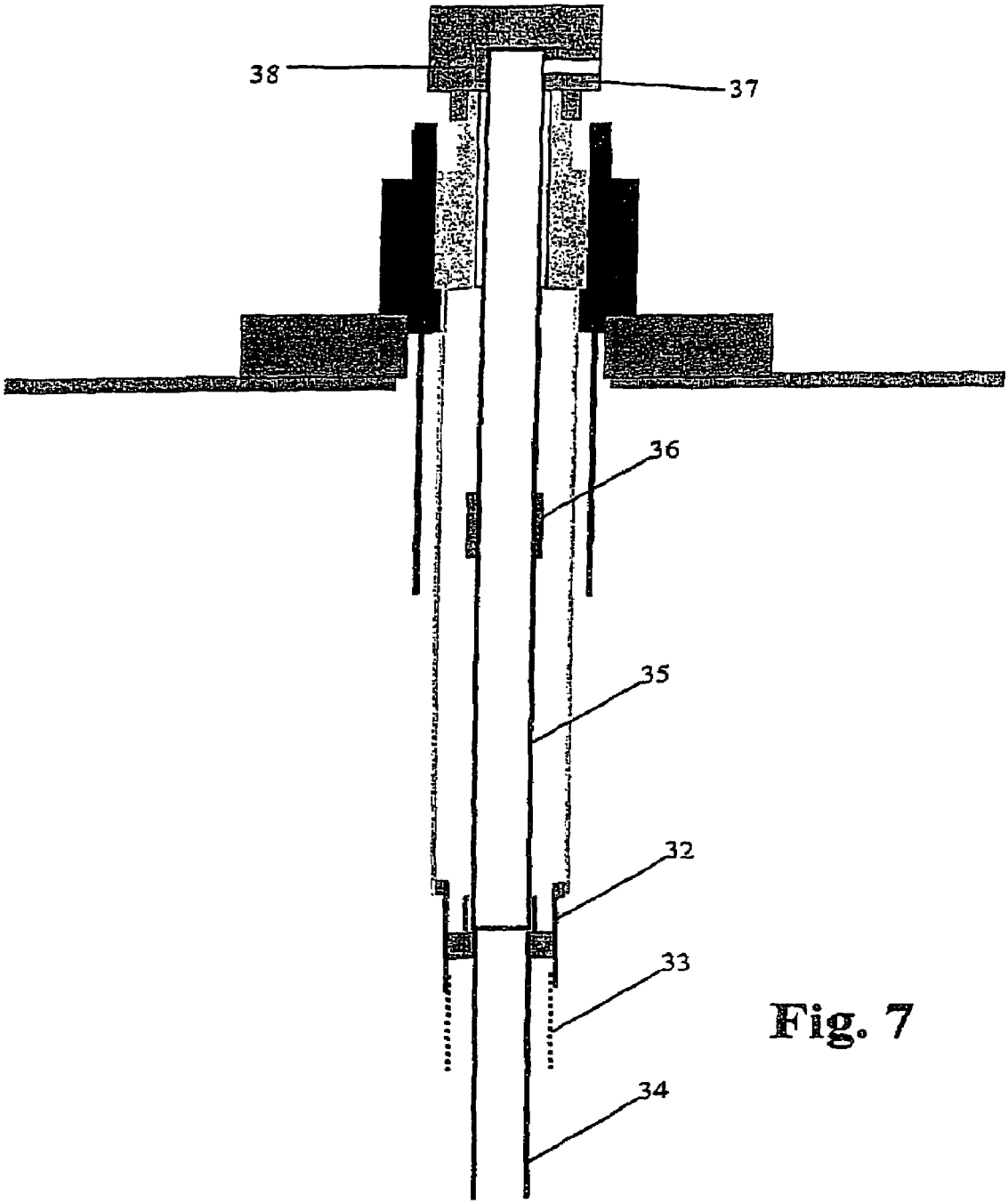
FIG. 7 shows a complete set of liners including an expandable liner after the drilling of the well is completed, according to a further embodiment of the invention.

FIG. 7 shows an alternative to a set of pre-positioned telescopic liners 1, 2. In this case only one liner 32 is pre-positioned below the wellhead. This liner 32 is lowered into the well bore and cemented substantially the same way as explained in connection with the 11¾" liner 1 in FIGS. 1 and 2. Thereafter a further borehole section is drilled. An expandable liner 33 is then inserted through the drilling riser 10 and the liner 32. Then the liner is cemented, expanded and set using conventional technology. The drilling is commenced by passing a drill bit with a diameter less than the internal diameter of the liner 33. Finally, a liner, e.g., a 7" liner 34 will be inserted through the well head, the liner 32 and the liner 33. An expandable liner hanger can also be used for suspension and sealing of the expandable liner 33.

An expandable liner hanger can also be used both for the pre-positioned liners (1, 2). A conical ring can be pre-positioned at any suitable place within the liner or liner hanger. The ring shaped cone can be installed in a section of the liner or liner hanger having a smaller material thickness than the surrounding sections of the liner or liner hanger. A tool acting on the cone by mechanical or hydraulic means can be used to force the cone into the section of the liner or liner hanger having a larger material thickness. Thus, the material of the liner or liner hanger will be forced radially outward and into contact with the larger casing or liner, in a per se now way in connection with conventional cones without a central opening. After the expansion, the ring shaped cone is left in place, since the internal diameter is large enough to allow equipment to pass.

The wells drilled and cased according to the present invention can also be used for production. A 7" tie-back string 35 with a downhole safety valve 36 can be installed. A horizontal x-mas tree 37 can be used to land and seal a tubing hanger 38. A shoulder with an internal diameter of approximately 8.6" should be sufficient to support a 9¼" external diameter tubing hanger.

Compared to a standard 18¾" wellhead system using 21" riser, 30" conductor casing, 20" surface casing (drilled without riser), 13⅜", 9⅝" casing and 7" liner, the system according to the invention, using a 10¾" riser allows for the same number of casing points, i.e., 18⅝" and 14" casing (drilled without riser), 11¾", 9⅝" and 7" liner drilled with riser. As an option, a 6" hole can be drilled and a 5" liner can be run and cemented.

The total hook load for suspending a 800 m long 14" casing with 800 m long sections of 11¾" and 9⅝" pre-positioned liners using a 5", 2500 m long drill string is in the order of 250 tons. Therefore, the selected drilling rig must have sufficient hook load capacity.

Depending on selection of casing and liner sizes and grade, a pressure rating between 5000 and 10000 Psi can be obtained. By increasing the wall thickness of the 11¾" pre-positioned liner and possible the 14" surface casing, a 10000 Psi completion is achievable. The pressure rating of post-expanded liners is reduced, and therefore, internal casing or liners may be needed to maintain the pressure integrity of the well.

The pressure rating of post-expanded liners is reduced, and therefore, internal casing or liners may be needed to maintain the pressure integrity of the well.

The invention allows wells to be drilled and completed using a smaller diameter drilling riser.

Combining the system with a high-pressure riser with surface BOP, the drilling riser can simply be a 10¾" casing without kill and choke line. This allows for fast installation and retrieval compared to conventional systems. Combining the present invention with a Low Riser Return System or Riser Lift Pump, would allow for further reduction in the number of liners and casings needed to complete the well. Using the slim riser would also allow the hole section 40 to be drilled with limited or no drill cuttings and drilling fluid discharge to sea. Using the slim riser and a Riser Lift Pump would also allow the hole section 41 to be extended significantly.

An 18¾" wellhead system for drilling in 2500 m of water requires a costly drilling vessel to be used. A typical cost of a large drilling vessel is in the order of 180,000 USD/day. The present invention allows for a low cost drilling vessel to be used since the volume and the weight of the marine drilling riser is only approximately 23% of a conventional system using a 21" marine drilling riser. A typical cost of a small drilling vessel (purpose build drill ship) is in the order of 150,000 USD/day. Assuming 35 days drilling time for both systems, the potential cost saving is in the order of 1,000,000 USD.

As indicated above, the drilling operation may be performed faster by using the present invention. This will allow for further cost reduction.

Alternatively, although it is not the best embodiment of the present invention, the pre-positioned liners may be installed in a lower part of the drilling riser having a larger diameter than the pre-positioned liners. Above this lower part the diameter of the drilling riser can be reduced under the diameter of the pre-positioned liners. The internal diameter of the well head will of course have to be larger than the pre-positioned liners. By this the substantial part of the drilling riser may have a reduced diameter.

What is claimed is:

1. A method for drilling and lining a subsea well, comprising in sequence:

drilling a first bore hole section at a subsea bore site, riserlessly;

pre-positioning below a well head and within a surface casing at the subsea bore site, at least one liner with a larger external diameter than a drilling riser not yet installed;

installing the drilling riser by coupling the riser to the well head, said riser extending to the sea surface so as to connect a drilling rig to said bore site;

lowering a drill string through the riser and the at least one liner;

drilling a subsequent bore hole section with a diameter exceeding the diameter of the at least one liner, the subsequent bore hole section having a larger diameter than the at least one liner; and installing the at least one liner into the subsequent bore hole section.

2. A method for drilling and lining a subsea well, comprising in sequence:

drilling a first bore hole section at a subsea bore site, riserlessly;

pre-positioning, below a well head and within a surface casing at the subsea bore site, at least one liner with a larger external diameter than a drilling riser not yet installed, and a drill bit below the at least one liner, said drill bit having a larger diameter than the external diameter of the at least one liner;

installing the drilling riser by coupling the riser to the well head above the bore site, said riser extending to the sea surface so as to connect a drilling rig to said bore site;

lowering a drill string through the riser and operatively coupling said drill string to said drill bit;

drilling a subsequent bore hole section having a larger diameter than the at least one liner; and installing the at least one liner into the subsequent bore hole section.

3. A method according to claim 1, said pre-positioning of the at least one liner comprising positioning the at least one liner within the surface casing while the surface casing is above the sea surface, and lowering the surface casing and the at least one liner into the first bore hole section as a unit.

4. A method according to claim 3, wherein the well head is coupled to the surface casing while the surface casing is above the sea surface before lowering the unit into the first bore hole.

5. A drilling and liner system for drilling a subsea well, comprising;

a subsea well bore site;

a subsea well head;

a subsea surface casing;

a drill string;

a drill bit;

a drilling riser; and at least one liner with a larger external diameter than the drilling riser;

the liner being pre-positioned below the well head and within the surface casing at the bore site;

the drill bit being adapted for insertion into the bore hole by means of the drill string through the riser, the well head and the at least one liner, and for drilling of a bore hole section of a diameter sufficient to receive the at least one liner.

6. A drilling and liner system for drilling a subsea well, comprising:

a subsea well bore site;

a subsea well head;

a surface casing;

a drill string;

a drill bit;

a drilling riser not yet coupled to said subsea well head; and at least one liner with a larger external diameter than the drilling riser, said liner being pre-positioned below the well head and within the surface casing at the bore site; the drill bit having a diameter larger than the at least one liner and being pre-positioned below the at least one liner, the drill bit being adapted for operatively coupling to the lower end of the drill string for drilling of a bore hole section of a diameter sufficient to receive the at least one liner.

7. A drilling and liner system according to claim 5, said at least one liner comprising at least two liners, wherein a first liner with a larger diameter is receiving a second liner with a smaller diameter in its interior.

8. A drilling and liner system according to claim 5, comprising a temporary sealing between the at least one liner and the surface casing at or near the lower end of the liner.

9. A drilling and liner system according to claim 5, wherein said at least one liner comprises an expandable liner and an expanding cone, said cone comprising a part shaped as a conical ring with a maximum outer diameter corresponding to the internal diameter of the expandable liner when expanded.

10. A drilling and liner system according to claim 5, having an expanding cone comprising a part shaped as a conical ring with a maximum outer diameter corresponding to the internal diameter of an expandable liner hanger when expanded, and an internal diameter which is equal to or larger than the external diameter of any parts that have to pass through to the sections of the well below the cone.

11. The method according to claim 1, said lowering a drill string through the riser and the at least one liner comprising:

lowering an expandable drill bit through the least one liner and expanding the expandable drill bit below the least one liner.

12. The method according to claim 1, comprising:

pre-positioning at least one drill bit with a larger diameter than the external diameter of the least one liner below the least one liner.

13. The system according to claim 7, having temporary sealing between said first liner and the surface casing at or near the lower end of the liner and between said first liner and said second liner.

14. The system according to claim 6, said at least one liner comprising a first liner with a larger diameter receiving a second liner with a smaller diameter in its interior.

15. The system according to claim 14, having temporary sealing between said first liner and the surface casing at or near the lower end of the liner and between said first liner and said second liner.

16. The system according to claim 6, comprising a temporary sealing between the at least one liner and the surface casing at or near the lower end of the liner.

17. The system according to claim 6, said at least one liner comprising an an expandable liner and an expanding cone, said cone comprising a part shaped as a conical ring with a maximum outer diameter corresponding to the internal diameter of the expandable liner when expanded.

18. The system according to claim 6, having an expanding cone comprising a part shaped as a conical ring with a maximum outer diameter corresponding to the internal diameter of an expandable liner hanger when expanded, and an internal diameter which is equal to or larger than the external diameter of any parts that have to pass through to the sections of the well below the cone.

19. The drilling and liner system of claim 5, said liner being pre-positioned within the surface casing.

20. The drilling and liner system of claim 6, said liner being pre-positioned within the surface casing.

* * * * *